United States Patent [19]

Laverdure

[11] Patent Number: 4,917,267

[45] Date of Patent: Apr. 17, 1990

[54] SELF-CLOSING VALVE WITH TAMPER EVIDENT LIP SEAL TAB FOR LIQUIDS, PASTES OR SOLIDS

[76] Inventor: Roland J. A. Laverdure, 17027 N. 95th Dr., Sun City, Ariz. 85373

[21] Appl. No.: 216,856

[22] Filed: Jul. 8, 1988

Related U.S. Application Data

[63] Continuation-in-part of Ser. No. 929,613, Nov. 12, 1986, abandoned, which is a continuation-in-part of Ser. No. 816,238, Jan. 6, 1986, abandoned.

[51] Int. Cl.[4] ..... B65D 35/08; B65D 35/48

[52] U.S. Cl. ..... 222/107; 222/212; 222/494; 222/541

[58] Field of Search ..... 222/211, 212, 490, 494, 222/541, 107

[56] References Cited

U.S. PATENT DOCUMENTS

| | | | |
|---|---|---|---|
| 2,333,587 | 11/1943 | Salfisberg | 222/541 X |
| 2,663,461 | 12/1953 | Brown | 222/107 |
| 2,893,611 | 7/1959 | Akers | 222/541 X |
| 2,904,225 | 9/1959 | Earles | 222/494 X |
| 3,255,925 | 6/1966 | Park | 222/107 |
| 3,342,318 | 9/1967 | Ruekberg et al. | 222/490 X |
| 3,506,163 | 4/1970 | Raum et al. | 222/490 X |
| 3,610,477 | 10/1971 | Herzig | 222/213 |
| 3,841,537 | 10/1974 | Marg et al. | 222/541 |
| 3,878,977 | 4/1975 | Carlisle | 222/107 X |
| 4,284,213 | 8/1981 | Lee | 222/539 X |
| 4,319,701 | 3/1982 | Cambio | 222/541 |
| 4,564,130 | 1/1986 | Eulenburg | 222/207 |
| 4,640,441 | 2/1987 | Bunschoten | 222/541 X |

*Primary Examiner*—F. J. Bartuska

[57] ABSTRACT

The invention pertains to a thermoplastic squeezable self-closing valve, capable of discharging, at requlated flow rates, liquids, pastes and solids such as powder, pills capsules and the like. This novel valve can be formed as an integral part of the container; or separately for attachment to other than flexible plastic containers; or thermoformed and heat sealed with a separable lip seal shipping tab after the container filling operation, thereby eliminating easily removable screwed bottle caps and the like for tamper protection of container contents. Other novel valve features includes methods, for drip prevention; establishing a liquid spray; forming a built-in clip lip seal; forming the squeezable valve as part of the hollow cored lifting handle used in present plastic milk and juice containers.

8 Claims, 3 Drawing Sheets

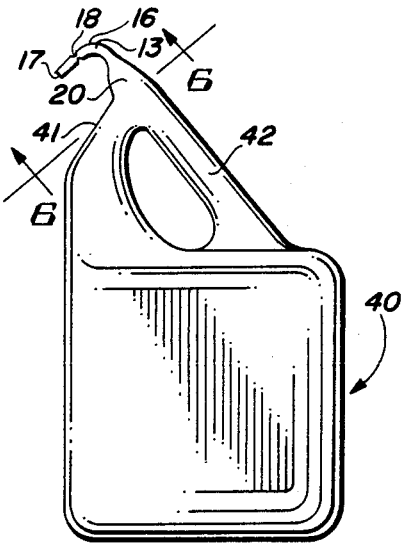
FIG. 5
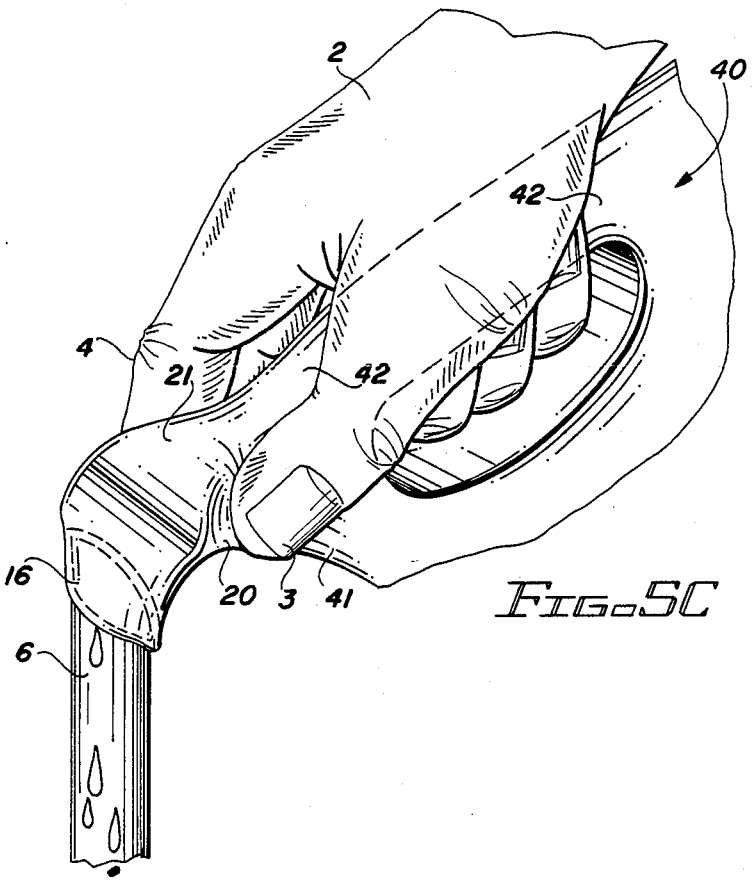
FIG. 5C
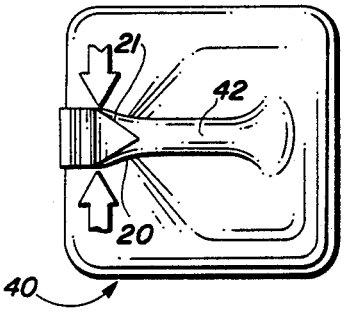
FIG. 5A
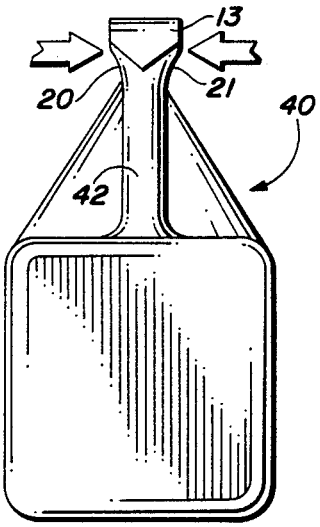
FIG. 5B
FIG. 6
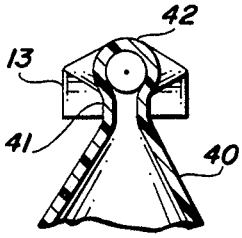
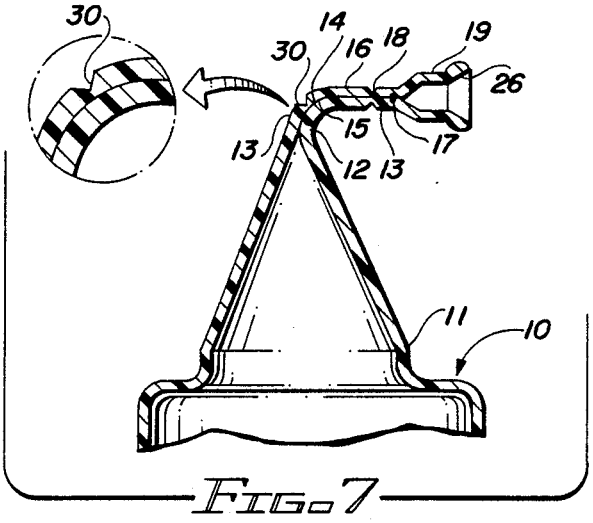
FIG. 7

SELF-CLOSING VALVE WITH TAMPER EVIDENT LIP SEAL TAB FOR LIQUIDS, PASTES OR SOLIDS

CROSS REFERENCE TO RELATED APPLICATIONS

This application is a continuation-in-part of copending U.S. patent application Ser. No. 929,613, filed Nov. 12, 1986, which is a continuation-in-part of U.S. patent application Ser. No. 816,238, filed Jan. 6, 1986, both of which are now abandoned.

BACKGROUND OF THE INVENTION

1. Field of the Invention:

This invention relates to a squeezable self closing plastic valve which relies upon novel structural features to assist the inherent memory of the plastic material, to perform and retain its ability, to flex and seal. The valve can be made, as a separate unit for fastening to a container or, by clamping, heating, compressing and cooling the neck of a thermoplastic bottle or container, immediately after the product filling operation. During the heat forming of the valve, the discharge lips can be sealed gas tight, with a tear-off type shipping tab, which offers tamper protection during storage until torn off by the consumer. After the removal of the seal tab, a compression type lip seal clip may be used, for compressing the valve discharge lips tighter than normal, for prevention of decarbonation of the likes of soft drinks, or leakage that could occur should the container be jostled or manhandled. Normally, for readily consumable products, such as milk and juices or high viscosity pastes, the lip seal clip is not required. An alternate method for filling the container with product, can be accomplished by pre-molding the flexible thermoplastic self-closing valve portion with its separable shipping lip seal tab portion unsealed as integral parts of the container. After the product filling of the container, accomplished by squeezing the self-closing valve portion in the open position, the shipping lip seal tab can be heat sealed closed.

The self closing valve can be applied to all types of plastic containers such as squeezable, collapsible tube type, bellows and even rigid plastic, metal or glass containers.

This invention also relates to the bottle closure industry. It offers a new, simpler and cheaper method for sealing thermoplastic containers, without using costly conventional screw-on sealing caps.

This invention further offers a unique method for making a container without joints that can be easily tampered with.

This invention also relates to spray pumps in that it offers a novel and less costly method for obtaining a liquid jet stream discharge.

2. Description of the Prior Art:

U.S. Pat. No. 3,610,477 (Herzig) discloses a squeeze bottle having an automatic closure. The automatic closure is the result of forming the end of the container, as by heat sealing. Different embodiments are disclosed, such as reinforcing ribs for the closure, a clip which fits over the container outlet, and nested curves formed in panels at the outlet. Material is expelled from the container by squeezing the container to open the lips.

U.S. Pat. No. 3,777,949 (Chiquiaria-Arias) discloses a disposable container having a tab sealing the discharge opening and a cap covering the discharge opening and the tab. The cap is used to twist off the tab so that there is no contamination by contact with the hands in removing the tab.

U.S. Pat. No. 4,252,257 (Herzig) discloses a container having a pinch-off fold at an outlet. Discharge of the container requires the use of pressure being applied at its different areas. When the pressure is released, the outlet closes automatically due to internal pressure of the material in the container. The discharge of material requires two hands, with the fingers of one hand applying pressure at a specific area to cause the discharge opening to open and then pressure on the container for discharging the contents. Liquids only may be discharged from the apparatus since the internal pressure of the liquids is required to maintain the seal.

U.S. Pat. No. 4,553,686 (Dougherty) discloses a drop dispenser apparatus with a patent configuration of seal elements or valves at the discharge portion of the apparatus. As with the Herzig U.S. Pat. No. 4,252,257, the apparatus is designed only for discharging liquids, and the apparatus is specifically designed for discharging drops of a liquid. The container is deformable, and pressure is applied to the container to discharge the liquid drops.

It is acknowledged that seal or shipping tabs are presently used, such as depicted in U.S. Pat. No. 3,777,949 (Chiquiaria-Arias). Most, however, seal off a container outlet, which upon removal of the seal tab, exposes a discharge opening that normally cannot be resealed, unless provided with a separate cap. Whereas, the apparatus herein offers a seal tab, which when removed exposes the closed outlet lips of the self-closing valve which can be digitally opened or closed as desired. It is further acknowledged that other types of seal tab such as depicted, but not claimed, in Herzig's U.S. Pat. Nos. 3,610,477 and 4,252,257 for automatic closures provides a removable cover which can not be considered gas tight such as claimed in the application herein. Furthermore, the seal tab claimed herein is an integral part of the self-closing valve body which is formed simultaneously during the thermoforming of the self-closing valve. No additional cover, cap or separate operation is needed for making the seal. The most novel part of this lip seal tab is that it can be provided with a built-in lip seal clip housing which is also an integral part of the self-closing valve. To further enhance the tamper-proofing merits of this seal tab, the Company Logo can be imbedded across the scored portion, where the valve discharge lips and the lip seal tab portion are joined, thus making tampering at this joint more difficult to reseal and match the halved company logo.

It is also acknowledged that other types of automatic closures for handling liquids have been patented, such as Hergiz's U.S. Pat. Nos. 3,610,477 and 4,252,257, which require they be made part of a flexible thin film tubular shaped container capable of being squeezed in order to dispense the liquid; whereas the self-closing valve described herein can be fastened to any container, whether rigid, flexible, or otherwise, since the valve itself is structurally designed to allow it to be digitally squeezed for dispensing product be it liquid, paste or solids such as pills, capsules, etc.

Most plastic bottles or containers depend on a seal to keep the contents from escaping, yet permit easy opening and resealing.

A variety of closures are presently being used to facilitate the sealing and opening, such as flip-top caps with built-in or swing-out pouring spouts, snap caps, twist and push-down types, which normally require a threaded joint for fastening to the container which requires extra wall thickness at the bottle neck and shoulder for making the threaded joint tight and resistant to top load stress, shear and deformation during the capping operation. Often additional gaskets or glued-on tamper evident aluminum or plastic liners are required to make the seal tight.

The dairy and fruit juice industries have developed packaging concepts employing plastic tear-off caps when large plastic containers (one or half gallon sizes) are used. For smaller sizes, having shorter shelf life, the famous pre-waxed or plastic coated, flat-topped gable roofed cardboard container is used, where the user has to tear part of the top off and bend part of the gable out to form the discharge spout. The usage of an all plastic self-closing valve and container eliminates the problems encountered with opening the cardboard spout, providing a more positive closure and leak proof container. For the larger half and one gallon plastic containers, the self-closing valve can be incorporated into the container's lifting handle and made into a combination lifting, pouring, discharge spout. Naturally this feature can be used for other products besides milk and juices.

Metal cans are often used for soft drinks and beer and the like, which when unsealed have no provision for preventing the decarbonation and decomposition of the contents whereas plastic cans with a self closing valve, with lip seal tab having a built-in seal clip housing could be used. This same concept could be used by the canning industry, provided a suitable vapor barrier can be developed for foods that require longer shelf life.

SUMMARY OF THE INVENTION

The invention described and claimed herein comprises a container, made of plastic material, for containing liquids, pastes, solids such as pills, capsules and the like, and for discharging the materials through self-sealing outlet structures. The outlet structures are self-closing valves thermoformed into different configurations. Heat forming is accomplished over a relatively long length of a discharge outlet so as to impart a memory into the discharge lips to provide a valve for controlling the discharge of the material. Finger pressure may be applied to open the valve's structure to allow material to be disbursed. A shipping tab, also heat formed at the end of the discharge nozzle, seals the container to prevent contamination or removal or the insertion of foreign material until the apparatus is used by its end user.

Among the objects of the present invention are the following:

To provide a new and useful container apparatus;

To provide a new and useful valve apparatus for controlling the discharge of material from a rigid or flexible container;

To provide a new and useful container apparatus having heat formed valve elements for controlling the discharge of material;

To provide a new and useful self-closing valve apparatus for a container capable of discharging liquids, pastes, solids such as pills, capsules and the like; and

BRIEF DESCRIPTION OF THE DRAWINGS

FIG. 5 shows side view of a conventional one gallon milk or juice plastic container with a self closing "C" shaped valve as part of the lifting handle.

FIG. 5A is a top view of FIG. 5. Arrows show where digital pressure (thumb and index finger) can be applied for opening the valve into the discharge position.

FIG. 5B is a side view of FIG. 5.

FIG. 5C shows how digital pressure is applied when lifting the container.

FIG. 6 is a partial cross section through section 6–6 of FIG. 5.

FIG. 7 is a cross sectional view of the curved quadrant shaped self-closing valve in its shipping position having a relatively "V" shaped notch midway on the outside of its outermost wall.

DESCRIPTION OF THE PREFERRED EMBODIMENTS

Figure 1A:
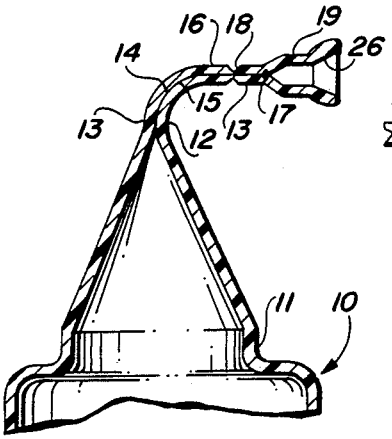
FIG. 1A is a cross sectional view of the self closing curved quadrant shaped valve in its shipping position.
Figure 1B:
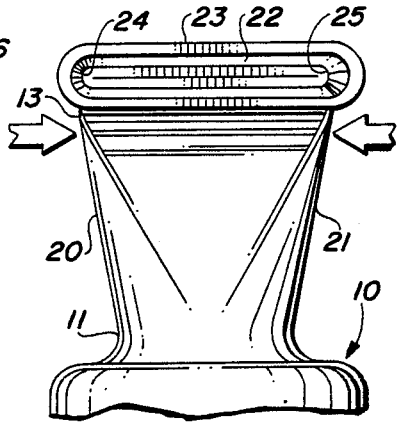
FIG. 1B is a side view of FIG. 1A. It shows a wide nozzle for discharge of pills, capsules, solids, etc., and increased liquid discharge rate. Arrows show where digital force is applied for discharging.

FIG. 1A is a side view in partial section of the upper portion of a container 10, for containing liquids, pills, solids, such as powder, pills, capsules and the like. FIG. 1B is a front view of the container apparatus 10 of FIG. 1A. FIG. 1C is a top view of the container apparatus 10 of FIGS. 1A and 1B. The container 10 is sealed, as will be discussed below.

At the upper portion of the container 10 is a relatively short neck outlet 11. The neck outlet 11 includes outwardly tapering sides 20 and 21. The outwardly tapering sides 20 and 21 are formed by pressure applied to a circular neck outlet to form, specifically, a curved portion 12 which comprises the beginning of a valve outlet for the apparatus. The valve apparatus is selfclosing, as will be discussed below. As heat and pressure are applied to the circular cylindrical neck outlet 11, the neck outlet is flattened and broadened to define the outwardly tapering sides 20 and 21. The heat forming specifically provides for opposing walls 14 and 15, which comprise continuations of the outwardly tapering walls 20 and 21, respectively, and also comprise the nested walls defining the valve elements of the apparatus of the present invention. The opposing walls 14 and 15 curve, and the curve may be defined as a curve quadrant 12 which has a predetermined radius extending from the slotted outlet 13 to outlet lips 16. The heat and pressure applied in forming the nested opposing walls 14 and 15 is not sufficient to weld them together, but is sufficient to impart into the thermoplastic material a memory after cooling prior to release from the thermoforming tool which causes the walls to nest against each other and to form the tapering sides 20 and 21 and the slotted outlet 13, and the walls 14 and 15 to the outlet lips 16.

Additional pressure and heat from the outlet lips 16 outwardly provide a lipseal weld 17. A scored notch 18 between the outlet lips 16 and the lipseal weld 17 allows the lipseal weld 17 to comprise a shortened portion which may be removed by a user.

A seal clip housing 19 is also formed as an integral part of the container 10 outwardly, or remote from, the scored notch 18 and the lipseal weld 17. The seal clip housing 19 includes a clip housing core 22, which is the portion of the housing adjacent to the clip seal weld 17. A clip housing reinforcing element 23 extends about the housing 19, between a pair of opposite end core housings 24 and 25. The end core housings 24 and 25 comprise the sides or ends of the end core housing and the clip reinforcement 23 comprises the outer reinforcement joining the sides 24 and 25. An outwardly extending beveled portion 26 acts as a guide to guide the housing onto the outlet lips 16 when the housing 19 is removed from the container 10 and is used as a seal for the lips 16.

Figure 1D:
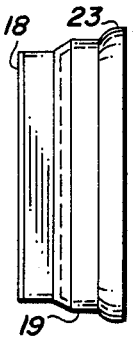
FIG. 1D shows the shipping tab as removed from FIG. 1C.

FIG. 1D is a top view of the seal clip housing 19 after it is removed from the outlet lips 16.

Figure 1E:
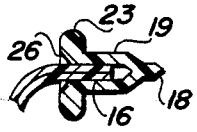
FIG. 1E shows the shipping tab housing compression clip, sealing the valve lips.

FIG. 1E is a view in partial section showing a seal clip housing 19 secured to the outlet lips 16.

In FIG. 1B, large arrows on the tapering sides 20 and 21 adjacent to the slotted outlet 13 illustrate where finger pressure is applied to open the valve defined by the opposing walls 14 and 15 that allow material to be dispensed from the container 10.

Figure 1F:
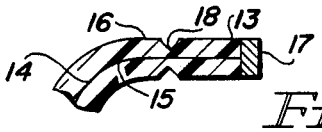
FIG. 1F shows an enlarged view of the preferred alternate shipping tab, without the lip seal clip housing. Darkened area denotes plastic melt area away from lips, denoting sealed lips, with "V" notches denoting tear-off section.
Figure 1C:
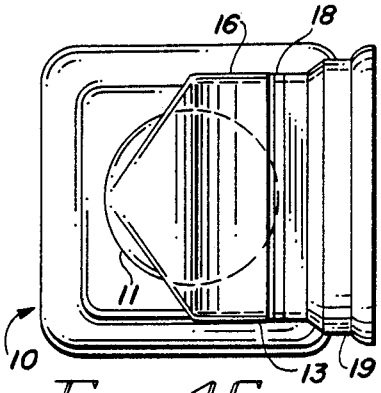
FIG. 1C is a top plan view of FIG. 1A.

FIG. 1F is a view in partial section illustrating the curvature of the opposing walls 14 and 15, and of their nested configuration, as when the valve is closed. The outlet lips 16 are shown closed, or adjacent to each other. The scored notch 18 is shown between the outlet lip 16 and the lipseal weld 17. In FIG. 1F, the seal clip housing 19 has been eliminated. The valve apparatus, comprising the opposing walls 14 and 15 accordingly do not require or do not use a seal clip housing. Rather, they simply depend on the inherent characteristics of the thermoplastic material out of which they are made to provide the sealing engagement of the walls 14 and 15.

Figures 2A, 2B:
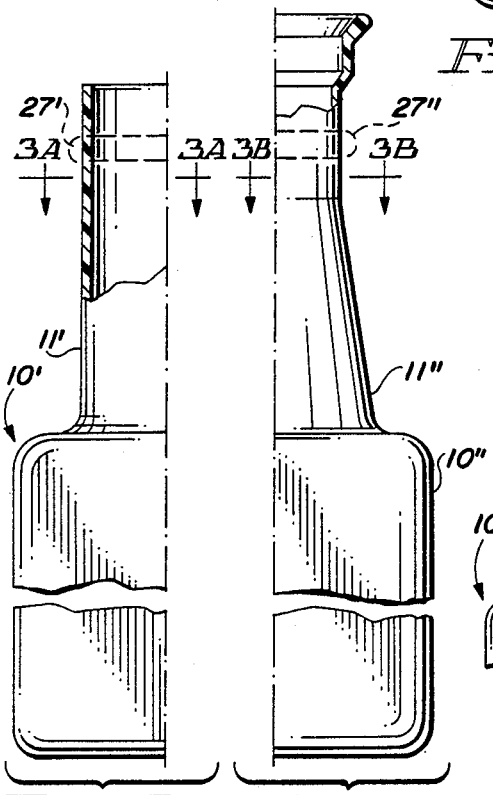
FIGS. 2A and 2B show a container which can be preformed with either of two differently shaped elongated neck outlets; the right hand section for thermoforming a valve portion with lip seal clip housing as shown in FIGS. 1A and 7 and with reinforced lips as shown in FIG. 4; the left hand section for thermoforming a valve portion with lip seal only as shown in FIGS. 5, 9, 10, 11, and 13 and with reinforcing ring about the cylindrical neck portion, shown in broken lines, should lip reinforcing be required.

FIGS. 2A and 2B depict containers 10' and 10'' respectively, each having differently shaped elongated neck outlet portions.

FIG. 2A, the left hand elevation, shows a generally cylindrical elongated neck outlet portion 11' which can be thermoformed into the flexible self-closing curved quadrant shaped valve shown in FIG. 1A, but having only the simple lip seal tab as shown in FIG. 1F. The preformed reinforcing ring portion 27, shown in phantom, may be required for reinforcing the valve lips depending upon the wall thickness and type of plastic used.

Figure 4B:
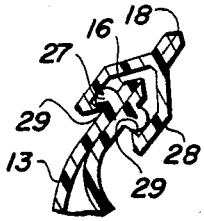
FIG. 4B shows the shipping tab housing compression clip, sealing the valve lips.
Figure 4:
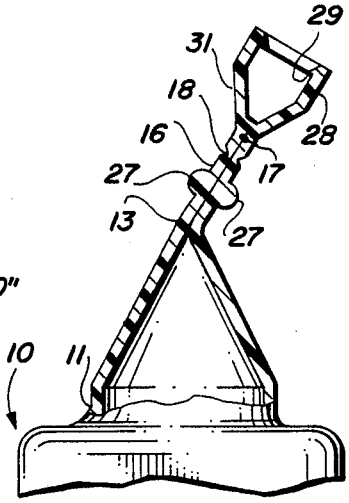
FIG. 4 is a cross sectional view showing a self closing valve with shortened discharge slot with rib reinforcement at the lips, complete with its lip seal shipping tab attached.

FIG. 2B, the right hand elevation, shows an elongated flattened elliptical neck outlet portion 11'' with preformed parts required for thermoforming the flexible self-closing curved quadrant shaped valves as shown in FIGS. 1A, 4, complete with combination lip seal and built-in lip seal clip housing. The elongated neck outlet portion 11'' is shown flattened and elliptical to facilitate the clamping of the nozzle for the thermoforming operation. The preformed reinforcing ring portion 27'' shown in phantom may be used to reinforce the valve lips when required.

Figures 3A, 3B:
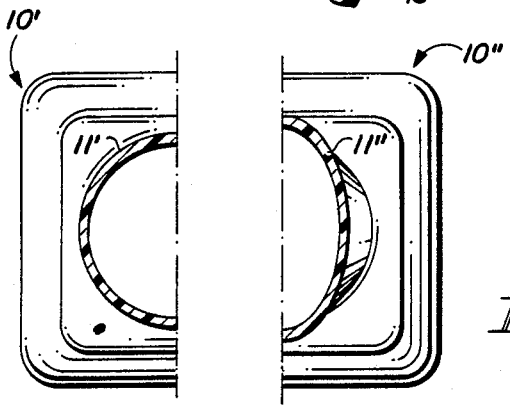
FIGS. 3A and 3B are top cross sectional views showing the elliptical shape at one half (3B) and a circular shape at the other half (3A) of section 3A–3B of FIGS. 2A and 2B.

FIG. 3A is a partial plan view of the FIG. 2A elevation taken through partial section 3A, which shows the container portion 10' with its adjoining generally cylindrical outlet portion 11'.

FIG. 3B is a partial plan view of the FIG. 2B elevation taken through partial section 3B which shows the container portion 10'' with its adjoining flattened elliptical outlet portion 11''.

FIG. 4 is a view of an upper portion of the seal container 10 with its neck outlet 11 shown in partial section. The neck outlet 11 is shown tapering inwardly to the slotted outlet 13. The apparatus of FIG. 4 differs from the apparatus of FIG. 1A,in that the curved outlet portion has a shorter arc length than does the apparatus of FIG. 1A, which necessitates the need for valve lip reinforcing elements 27 which the apparatus of FIG. 1A does not have.

The reinforcing ribs 27 extend laterally with respect to the neck outlet 11. The ribs 27 are adjacent to the outlet lips 16. The apparatus of FIG. 4 includes a large seal clip housing 28 secured adjacent to the lip seal weld 17. The lip seal weld 17 is adjacent to the scored notch 18.

When the apparatus of FIG. 4 is to be used, the seal clip housing 28 is removed at the scored notch 18. It will be noted, as best shown in FIG. 4B, that the seal clip housing 28 is of sufficient size to extend over the valve lip reinforcing element 27.

FIG. 4B is a view in partial section of the outer portion of the valve apparatus portion of FIG. 4, showing the housing 28 disposed over the outlet lips 16 and over the reinforcing ribs 27.

Figure 4A:
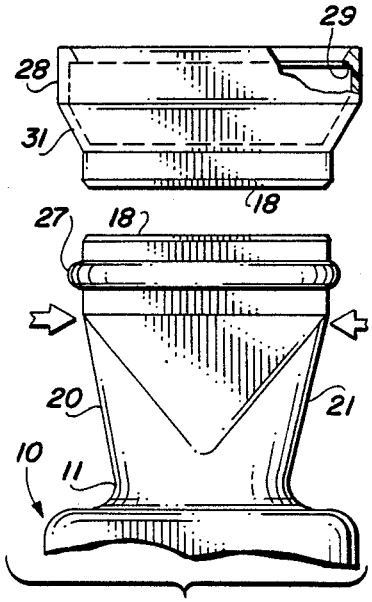
FIG. 4A is a side view of FIG. 4, with its lip seal shipping tab detached. Arrows show where digital pressure is applied for discharge.

FIG. 4A is a front view of the apparatus of FIG. 4 illustrating the outwardly tapering neck outlet 11, and showing the large seal clip housing separated from the container apparatus at the scored notch 18.

The seal clip housing 28 includes an outwardly flaring portion 31 and a retention lip portion 29. The lip retention portion 29, as shown in FIG. 4B, extends over the valve lip reinforcing elements or ribs 27.

Returning again to FIG. 4, it will be noted that the angular orientation of the slotted outlet 13 is about thirty degrees to the cylindrical axis of the container 10. In FIG. 1A, the angular orientation of the valve elements is about ninety degrees to the longitudinal axis of the container 10. However, it will again be noted, as shown in FIGS. 4 and 4B, that the elements of the outlet lips 16 are disposed against each other, and are normally biased against each other through the inherent characteristics out of which the apparatus is made.

In FIG. 4A, a pair of large arrows indicate the location of the application of pressure to cause the outlet lips 16 to open in order to allow material within the container 10 to be dispensed. The application of an inwardly directed force results in the valve apparatus, or the outlet lips 16 of the valve apparatus, to open as desired.

FIG. 5 is a side view of container apparatus 40 which includes valve apparatus discussed above. FIG. 5A is a top view of the container apparatus 40 of FIG. 5. FIG. 5B is a front view of the container apparatus 40 of FIG. 5. FIG. 5C is a perspective view of a portion of the container apparatus 40 illustrating the opening of the valve apparatus for dispensing material. FIG. 6 is a view in partial section of the apparatus of FIG. 5 taken generally along line 6—6 of FIG. 5. For the following discussion of the container apparatus 40 and its elements, reference will primarily be made to FIGS. 5, 5A, 5B, 5C, and 6.

Container apparatus 40 includes an integral container outlet 41 and an integral lifting handle 42. The container apparatus 40 also includes outwardly tapering side portions 20 and 21, substantially identical to the tapering sides of the container apparatus 10 discussed above. The outwardly tapering sides 20 and 21 extend to a slotted outlet 13. The slotted outlet 13 includes outlet lips 16 remote from the tapering sides 20 and 21. At the distal end of the outlet lips 16, remote from the container outlet 41, is a lip seal weld 17. The lip seal weld 17 includes a scored notch 18 for convenience in removing the lip seal weld when it is desired to remove material from the container 40.

As best shown in FIGS. 5 and 6, there is about a ninety degree curve in the slotted outlet 13 between the tapering sides 20, 21 and the scored notch 18 of the lip seal weld 17. In order to remove material from the container 40, the lip seal weld is broken off at the scored notch 18, and pressure is applied on the outwardly tapering sides 20 and 21, as indicated by the arrows in FIGS. 5A and 5B, and as shown in FIG. 5C.

FIG. 5C is a user's hand 2, shown holding the container apparatus 40, with a thumb 3 applying pressure to the outwardly tapering side 20, and a finger 4 applying pressure to the outwardly tapering side 21. This results in the opening of the outlet lips 16 to allow material 6 to be dispensed.

FIG. 7 is a cross-sectional view of the curved quadrant shaped self-closing valve complete with shipping tab as shown in FIG. 1A, having a relatively "V" shaped notch 30 mid-way on the outside of the outermost wall of the curved discharge slot, thus forming a linear compressed contact between the nested walls.

The "V" notches 59 are imbedded and formed during the heat crimping of the slotted outlet 52 to further compress the surface area of contact at the curved sections of the opposing walls 53 and 54.

Figure 10:
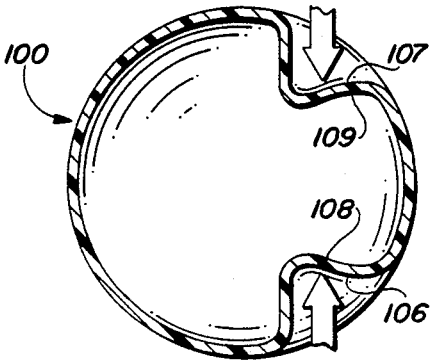
FIG. 10 is a cross-sectional view "10—10" taken through FIG. 9, which shows a pocketed type grasp handle. (Arrows show where digital pressure is applied for discharge.)

The discharge of product is made by merely squeezing the untapered cylindrical neck portion 84 as indicated by the arrows in FIG. 10. Upon release of the squeeze effort, the built-in plastic memory will cause the nozzle 84 to return to its original cylindrical shape while the lips of the valve 85 are closed, causing the piston 81 to be actuated by external atmospheric pressure to feed and fill the void with product within nozzle 84's restored original cylindrical shape, thus making it ready for subsequent product discharges by repeating the squeezing and release effort on nozzle 84 until the container 80 is emptied.

Figure 8:
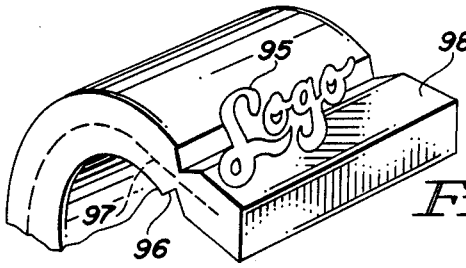
FIG. 8 shows where the Company logo can be imbedded across the lip seal tab tear-off line during the heat forming and crimping of the valve.

FIG. 8 is a perspective view of a portion of valve outlet lips 97, having a generally curved quadrant shape, with a lip seal tab 98 secured to the valve outlet lips 97. An embedded company logo 95 extends over the outer end of the lips 97 and onto the tab 98. The purpose of the logo 95 is, of course, dual in nature. The presence of the logo provides advertising and goodwill associated with the product or container to which the outlet lips are secured, and the logo also provides a confirmation of the integrity of the seal for the lips 97.

As with the other seal tabs discussed above, the seal tab 98 includes a pair of V-shaped grooves 96 at the juncture of the lips 97 and the tab 98 to aid in the removal of the tab 98 in order to use the apparatus, or to discharge material from the container to which the outlet lips 97 are secured, as desired by a user.

Figure 9B:
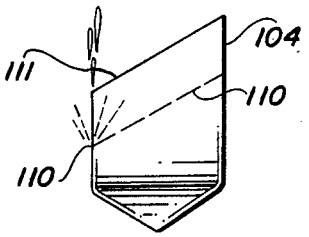
FIG. 9B is an enlarged plan view of FIG. 9, with the snap-on cap removed to show the diagonal or bias valve lip discharge outlets. The diagonal broken lines show where a spray pattern is obtained, whereas the solid diagonal line shows where a jet stream discharge can be obtained.
Figure 9:
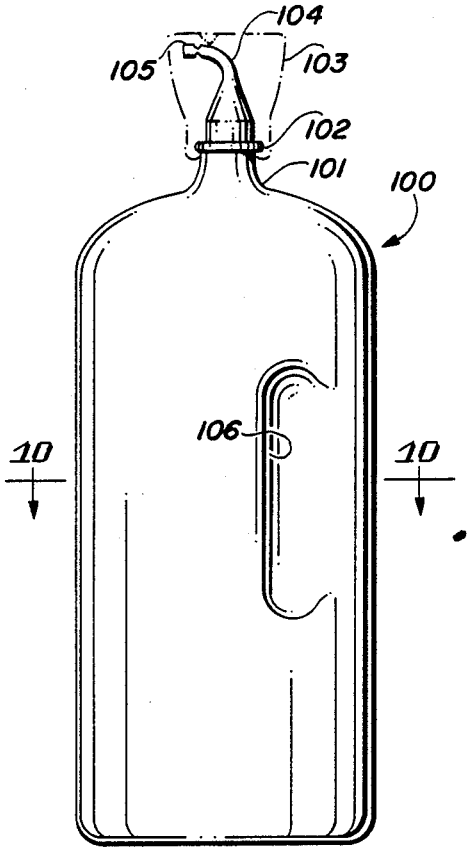
FIG. 9 shows a container having a pocketed flexible grab handle complete with a lip seal shipping tab, with snap-on cap shown in broken lines.
Figure 9A:
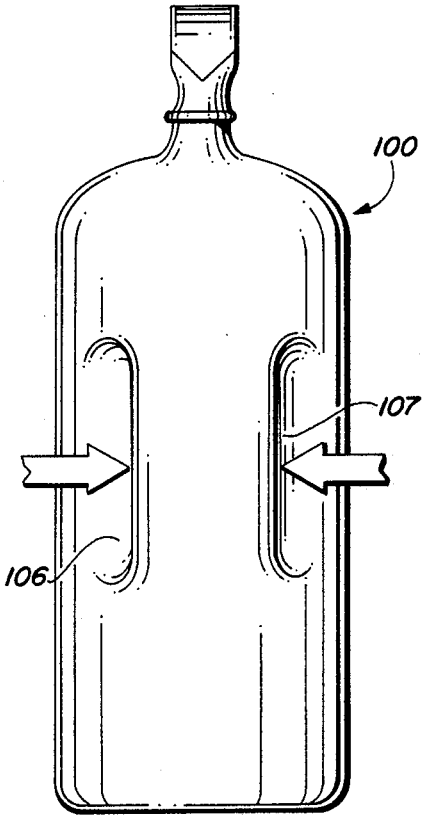
FIG. 9A is a side view of FIG. 9. (Arrows show where digital pressure is applied for discharge.)

FIG. 9 is a side view of a semi-rigid container 100. FIG. 9A is a rear view of the container 100. FIG. 10 is a view in partial section of the container 100 taken generally along line 10—10 of FIG. 9. For the following discussion of the container 100, reference will primarily be made to FIGS. 9, 9A and 10.

The container 100 includes a neck outlet 101 through which material is discharged and through which the container 100 is filled. A collar 102 is used to secure a discharge nozzle to the neck 101. The discharge nozzle extends to a curved quadrant shaped valve 104, which is substantially identical to the valve discussed above in conjunction with FIG. 1F. The valve 104 includes a lip seal tab 105.

A cap 103, also a snap-on cap, is used to cover the nozzle and the valve 104. The snap-on cap 103 includes a wedge, inserted within the upper inside portion of cap 103 for providing a downward bias on the valve 104 to insure the seal of the valve 104.

Extending inwardly on the sides of the container 100 is a pair of pocketed portions 106 and 107. The pocketed portions 106 and 107 provide two functions, first the function of enabling the container 100 to be easily held in one hand, and second the function of aiding in the discharge of material from the container 100. The pocketed portions 106 and 107 include thin wall areas 108 and 108 which will flex when the inward pressure is applied, as illustrated by the large arrows in FIGS. 9A and 10. Thus, when the inwardly directed pressure is applied on the thin walled areas 108 and 109 of the pocketed portions 106 and 107, respectively, material within the container 100 will be discharged through the curved quadrant shaped valve 104.

FIG. 9 is an enlarged top view of the valve 104, illustrating alternatives for discharging material from the container 100. A bias cut 110 is illustrated for providing a spray of material from the container 100. A second bias cut 111 is also shown for providing a jet-type stream of material from the container 100 and through the valve 104.

The present invention is the result of research done on vacuum-pressure type toothpaste pumps towards eliminating plug-up of the discharge spout, with caked or dehydrated product. A method for discharging and cutting off flow at the outlet lips was discovered which would not only eliminate plug-ups but could be used for discharge of other materials besides paste, such as liquids, or solids or mixtures thereof. Furthermore, this unique self-sealing flexible discharge closure valve can be used to replace the internal working parts, of the famous vacuum-pressure type toothpaste pump, other than the rigid housing and piston paste displacement unit. The flexible valve, for rigid housing applications, requires a vacuum tight threaded or other joint for fastening to the rigid housing.

For all other applications, particularly where tamper-proof packaging is required, the self closing valve can be made, as part of a thermoplastic container having no joints, by thermoforming the container neck at its softening point temperature, and heat sealing the lip seal tab, at its melting or welding temperature (not its softening point). This necessitates making special containers from thermoplastics, such as polyethylene, having generally cylindrical elongated discharge neck nozzle, long enough to permit the forming of the valve closure and the tear-off type lip seal tab. The forming of the container nozzle into a valve closure and lip seal tab can be accomplished with conventional heat forming tools, electric or cored hot water units. Depending upon the type and thickness of the plastic used, ultrasonic forming and welding can be used. Ultrasonic sealing is a "cool" process, with heat generated only at the interface of the material. Also, the process virtually imparts no heat to the package contents resulting in a more stable product, particularly suitable for packaging heat sensitive pharmaceutical products.

Another major advantage of this simple invention is that it offers a filled container that is positively sealed, ready for shipment, without joints or closures that can be lifted, flipped, unscrewed or tampered with, prior to consumption by the purchaser. It eliminates the need for shrink, bubble or blister wrapping for tamper protection as well as conventional cardboard wrapping. Above all is the fact that the valve is self-closing, and can be made of transparent plastic to show availability of product, for immediate discharge by the mere squeeze of the valve or the container, if squeezable or collapsible.

It is apparent from the foregoing that research and development must be spent, particularly if other than flexible thermoplastic material is being used; new formulations, plastic blends and/or vapor barriers may be required, in addition to making new molds and changes to production facilities. Much of these costs can be offset, not only by the sales appeal of a self closing valve by the general public but by realistic cost savings gained from elimination of conventional plastic or aluminum compression, screw or roll-on caps, and elimination of the extra bottle neck and shoulder reinforcing material which is required to withstand the top loading pressure while the cap is being fastened. The following is an example of potential cost savings gained from eliminating plastic caps that cost $8.00 per 1,000 units; presently used at a production rate of 2,000,000 one gallon milk containers per month (which is normal for the average dairy bottling plant) yields $16,000 per month, $192,000 per year or roughly $1,000,000 in five years. Naturally cost savings mount as the costs of caps increase. For example, the popular swing-out spout threaded cap ranges in price from $44 to $70 per 1,000, and the cost of caps used by the cosmetic and pharmaceutical industries can be expected to be much higher. Some of the cost savings can be used towards reinforcing the more resilient container body if need be, by structural means such as ribs, corrugations, etc., or by cross linking the thermoplastic molecules employing high energy radiation.

The invention described and claimed herein can be made from any thermoplastic material, such as flexible low density polyethylene, plasticized polyvinylchloride, special blends such as PET (polyethylene terephthalate) or newly formulated plastics for this application. Preferably, because of their low temperature softening points, and flexibility, low density polyethylene and flexible plasticized polyvinylchloride have been used to test the performance of the valve. The valve can be made by pinching a generally cylindrical nozzle (or bottle neck) at its outer end until it becomes flattened, at which time a heated clamping and forming tool is used to compress and form the nozzle into a widened, flattened, smooth curved quadrant discharge slot having opposed walls which form the contact sealing surface. The contact sealing or seating surface is kept from being joined or welded together by applying, no more heat than necessary, to form the curved discharge slot at the softening temperature of the plastic material, below its melting point temperature, which is the temperature used to weld the opposed walls extending from the discharged lips together into a lip seal tab, and if desired, with built-in clip housing. The tab is scored for easy removal and exposure of the valve lips to permit the discharge of product, be it liquid, paste, solids, such as powder, pills, capsules and the like.

For the normal storage of products, after the removal of the lip seal shipping tab, this invention depends upon the memory of the plastic at the curved discharge outlet for maintaining a sealed shut-off. If extended shelf life is desired, a clip may be used to keep the discharge lips in a prolonged compressed shut-off condition. The quadrant shaped curved are length of the contact seating surface of the valve required for sealing purposes varies with the product stored in the container. Liquids, for example require a longer contact surface than for sticky or paste like products. For solids, very little contact or sealing surface length is needed, other than to provide enough plastic memory for actuating and maintaining the closure shut-off. It is apparent that further sealing of the discharge lips can be accomplished by use of the built-in clip lip seal housing. For solids such as powder, pills, capsules and the like require no more than a loose "slip-on fit" at the jointly compressed contact surfaces, while for liquids such as carbonated soft drinks and the like additional outer rib reinforcing at the compression clip lip seal housing portion is required for a "push-fit" leakproof compression seal.

A major feature of this curved quadrant shaped valve, that stands out above all other automatic closures, is the unique feature of crimping a nozzle then heat forming it into a flattened curved and widened discharge slot complete with a lip seal shipping tab. The curved part naturally reinforces or stiffens the discharge lips which helps retain their reseating or sealing ability, whereas the widened part offers less resistance to flow, making it easier to open with less tensile stress, thereby lessening the fatigue factor which tends to shorten the life of the built-in memory of the plastic required for maintaining a tight seal.

Tests have shown that for most products having a short shelf life requirement, such as soda, beer, milk, toothpaste, cosmetics and pharmaceuticals, etc., that this presents no problem. Tests also have proven that sharp cramped or angled bends (rather than a smooth rounded curve of approximately ¼" inside radius for the discharge slot) offers too much resistance to flow, which also makes it more difficult to open for discharging products and reseat itself into a tight closure. Also note that there are no mechanical or springloaded devices required to perform the seal.

For products such as cosmetics, that require adornment or gold plated treatment for their packaging "sell" or for protection against dust accumulation during storage, an alternate method for sealing the discharge lips, after the removal of the shipping or seal tab, to prevent the escape of gases, aromas, etc., or leaks due to jostling and manhandling, is to provide a snap-on and/or twist locking type capped housing over the entire valve, which can be pushed and/or twisted downwardly against the top of the curved valved discharge lips to keep the outlet in a compressed tightened condition.

The most important structural feature of this "C" shaped valve is the flat wide discharge lips which are formed during the crimping operation. The width of the valve lips depends on the diameter of the nozzle, which when flattened and curved at its outlet end, causes the nozzle to outwardly taper towards the widened, curved and flattened discharge slot portion. The broadened outlet simplifies the discharge of solids, capsules, pills, etc., by upending the container and by merely digitally squeezing the outwardly tapering sides adjoining the widened, curved and flattened discharge outlet. The discharge outlet thus squeezed will form an opening equivalent to the cross sectional area of the nozzle; when digital pressure is released, the memory within the plastic of the curved section of the valve will reseat the valve lips and slot to its original tight shut-off condition. Experiments have shown a preference for using low density polyethylene for this wide mouth application using approximately 1+¼" O. D. nozzle by 1/32" wall thickness, with a minimum radius of curvature of approximately ¼" and having a surface contact arc length of approximately ¾".

Another important feature of this invention is that the valve and shipping or seal tab can be made simultaneously, if desired, immediately after the product filling operation. The valve is formed at the softening point of the plastic material, whereas the lip seal tab is sealed at its melting or welding temperature. For certain applications and to keep production cost down, the valve can be made without the shipping seal tab, using alternate means for sealing the valve during shipping and storage. The valve can also be made independently of the container, and provided with a female threaded connection for fastening, to new and existing conventional collapsible type tubes, such as for toothpaste, hair grooming gels, glues, etc.

Another novel application for the self closing valve is to form it as part of the lifting handle commonly used on large plastic bottles. The handles are usually cored hollow which aids to distribute the liquid from the container. The valve is located at the top of the handle, which can be easily manipulated, for discharging while lifting and holding the container in a tilted pouring position.

This invention stresses the importance of the curved quadrant shaped outlet for maintaining the memory of the plastic seal after removal of the tamper evident seal tab. Further assistance can be made by providing the clamping tool, used to thermoform the valve's discharge slot, with one or more "V" shaped pointed offsets, each having a ridge height of approximately half of the wall thickness of the discharge slot, laterally across the full width of the clamping tool; which when applied, countersinks into the plastic thus adding individually crimped linear contact surface(s) between the opposing walls of the valve's discharge slot which is also crimped and curved seal tight. Tests have shown that for the smaller ½" O. D. crimped nozzles two "V" offsets formed a drip tight seal. The drip tight valve is particularly ideal for frequent short term applications, such as for dishwashing detergents or cleaning solutions, where lip seal cap replacement becomes a neglected item.

Tests have shown that a spray or high velocity jet, as shown in FIG. 9B, can be had by providing a bias cut at the outlet of the discharge slot, using 5/16" O. D. ×1/32" wall thickness nozzle, preferably made of semi-rigid thermoplastic such as cellulosic or polyethylene terephalate (PET). The stiffer plastic maintains a tight seal which limits the amount of fluid that can be discharged, as well as, losing its ability to be digitally manipulated for dispensing; therefore dispensing can be accomplished only by squeezing and upending the container, which if made of semi-rigid plastic such as PET, can be made flexible enough for discharging, such as shown in FIGS. 9, 9A, 9B and 10.

In instances where liquid or gas sealing pressures are not involved, such as for the containment of dry powders, capsules, pills, etc., rather than reinforcing the self closing valve's discharge slot with a full ninety degree curved arc length, a shorter arc length can be used if it is rib reinforced at the widened discharge lips to provide the extra plastic memory required for reseating and sealing the valve.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. A sealed container having a squeezable thermoplastic self-closing valve portion capable of discharging liquids, pastes and solids, such as powder, pills, capsules and the like, including a separable shipping lip seal tab having a built-in compression clip lip seal housing portion comprising:

(A) said sealed container having a flexible thermoplastic elongated generally cylindrical outlet nozzle originally molded as part of the container body, said originally molded outlet nozzle includes an enlarged diametrical portion having outer rib reinforcing elements at its extreme outlet end for shaping the built-in compression clip lip seal portion during the thermoforming of the flexible thermoplastic self-closing valve portion:

(B) said squeezable thermoplastic self-closing valve portion is thermoformed and shaped by clamping, heating and compressing the container's elongated discharge outlet nozzle until it outwardly tapers to an adjoining widened, flattened, smooth curved quadrant discharge slot, said discharge slot having opposed nested walls substantially in face to face contact when said self-closing valve is in its normal closed position, said curved quadrant discharge slot retains its structural shape and self-closing integrity by cooling prior to release from the clamping means used for thermoforming, said opposed walls of the curved quadrant discharge slot have a thickness to ensure self-closing snap-back stress said snap-back stress, upon application of digital force at the exterior of the broadened outwardly tapering sides adjoining the widened, flattened curved discharge slot portion of the self-closing valve, is temporarily relieved causing the flattened curved quadrant discharge slot to tend to straighten out and return to its original elongated generally cylindrical outlet nozzle shape for dispensing product, when container is in an upended position:

(C) said separable shipping lip seal tab having a built-in compression clip lip seal housing portion includes:

1. a separable shipping lip seal tab portion integrally extending from the flattened curved quadrant discharge slot,
2. said separable shipping lip seal tab portion heat sealed, gas tight, for prevention of product discharge prior to consumer usage,
3. said separable shipping lip seal tab scored for tear-away separation for exposing the flattened curved self-closed discharge slot outlet for dispensing of product by the consumer,
4. said separable shipping lip seal tab extending into a pocketed built-in compression clip lip seal housing portion,
5. said built-in compression clip lip seal housing portion being formed of a size and shape to permit hand pressing for further compressing said portion over the exposed self-closed flattened curved quadrant discharge slot outer lip, whereby said scored section of said shipping lip seal tab being partly severed at said scored section, prior to purchase, indicates possible tampering for rejection by the consumer.

2. The sealed container of claim 1, having opposed nested walls whereas said opposed nested walls having one relatively "V" shaped notch mid-way on the outside of the outermost wall of the curved quadrant discharge slot, said "V" shaped notch being imbedded across the full width of said flattened curved quadrant discharge slot outlet portion by clamping means used to thermoform said self-closing valve, said clamping means being provided with a "V" shaped pointed offset having a ridge height of half the thickness of said outermost wall, which countersinks into said outermost wall of the curved quadrant discharge slot portion, forming a linear compressed contact between the nested walls into an improved drip tight liquid seal.

3. The sealed container of claim 1, having the arc length of said flattened curved quadrant discharge slot portion of the squeezable thermoplastic self-closing, valve, shortened and rib reinforced at its slotted discharge outlet.

4. A sealed container having a squeezable thermoplastic self-closing valve portion capable of discharging liquids, pastes and solids, such as powder, pills, capsules and the like, including a separable shipping lip seal tab having a built-in compression clip lip seal housing portion comprising:

(A) said sealed container having a flexible thermoplastic elongated generally cylindrical discharge outlet nozzle originally molded as part of the container body, said originally molded outlet nozzle includes an enlarged diametrical portion having outer rib reinforcing elements at its extreme outlet end for shaping the built-in compression clip lip seal housing portion during the thermoforming of the flexible thermoplastic self-closing valve portion:

(B) said squeezable thermoplastic self-closing valve portion is thermoformed and shaped, by clamping, heating and compressing the container's elongated discharge outlet nozzle until it outwardly tapers to an adjoining widened, flattened, smooth curved quadrant discharge slot, said discharge slot having opposed nested walls substantially in face to face contact when said self-closing valve is in its normal closed position, said curved quadrant discharge slot retains its structural shape and self-closing integrity by cooling prior to release from the clamping means used for thermoforming, said opposed walls of the curved quadrant discharge slot have a thickness to ensure self-closing snap-back stress, said snap-back stress, upon application of digital force at the exterior of the broadened outwardly tapering sides adjoining the widened, flattened curved discharge slot portion of the self-closing valve, is temporarily relieved causing the flattened curved quadrant discharge slot to tend to straighten out and return to its original elongated generally cylindrical outlet nozzle shape for dispensing product, when container is in an upended position:

(C) said separable shipping lip sealtab having a built-in compression clip lip seal housing portion includes:

1. a separable shipping lip seal tab portion integrally extending from the flattened curved quadrant discharge slot,
2. said separable shipping lip seal tab portion heat sealed, gas tight, for prevention of product discharge prior to consumer usage,
3. said separable shipping lip seal tab scored for tear-away separation for exposing the flattened curved self-closed discharge slot outlet for dispensing of product by the consumer,
4. said separable shipping lip seal tab extending into a pocketed built-in compression clip lip seal housing portion,
5. said built-in compression clip lip seal housing portion being formed of a size and shape to permit hand pressing for further compressing said portion over the exposed self-closed flattened curved quadrant discharge slot outer lip.
6. said built-in clip lip seal housing contacting the flattened curved quadrant discharge slot outer lip, being jointly compressed and fitted to suit the type of product stored within said sealed container, whereby said stored product being paste, solid such as powder, pills, capsules and the like require no more than a loose "slip-on fit" at the jointly compressed contact surfaces, whereas for liquids such as carbonated soft drinks and the like additional outer rib reinforcing at the built-in compression clip lip seal housing portion being required for a "push-fit" leakproof compression seal, said scored section of said shipping lip seal tab being partly severed at said scored section, prior to purchase, indicates possible tampering for rejection by the consumer.

5. A sealed container having a squeezable thermoplastic self-closing valve portion capable of discharging liquids, pastes and solids such as powder, pills, capsules and the like, including a separable shipping lip seal tab comprising:

(A) said sealed container having a flexible thermoplastic elongated generally cylindrical discharge outlet nozzle originally molded as part of the container body, said originally molded outlet nozzle for shaping and thermoforming the flexible thermoplastic self-closing valve portion:

(B) said squeezable thermoplastic self-closing valve portion is thermoformed and shaped, by clamping, heating and compressing the container's elongated discharge outlet nozzle until it outwardly tapers to an adjoining widened, flattened, smooth curved quadrant discharge slot, said discharge slot having opposed nested walls substantially in face to face contact when said self-closing valve is in its normal closed position, said curved quadrant discharge slot retains its structural shape and self-closing integrity by cooling prior to release from the clamping means used for thermoforming, said opposed walls of the curved quadrant discharge slot have a thickness to ensure self-closing snap-back stress, said snap-back stress upon application of digital force at the exterior of the broadened outwardly tapering sides adjoining the widened, flattened curved discharge slot portion of the self-closing valve, is temporarily relieved causing the flattened curved quadrant discharge slot to tend to straighten out and return to its original elongated generally cylindrical outlet nozzle shape for dispensing product, when container is in an upended position:

(C) said shipping lip seal tab includes:

1. a separable shipping lip seal tab portion integrally extending from the flattened curved quadrant discharge slot,

2. said separable shipping lip seal tab portion heat sealed, gas tight, for prevention of product discharge prior to consumer usage,

3. said separable shipping lip seal tab scored for tear-away separation for exposing the flattened curved self-closed discharge slot outlet for dispensing of product by the consumer,

4. said separable shipping lip seal tab portion during heat forming imbeds a company logo extending laterally over the section to be scored, whereby said scored section of said shipping lip seal tab having the company logo imbedded, being partly severed at said scored section, prior to purchase, indicates possible tampering for rejection by the consumer.

6. The sealed container of claim 5 being a hand held flexible container body having said flattened curved quadrant discharge slot outlet portion of the said self-closing valve made of semi-rigid thermoplastic provided with two separate scored tear-away sections each cut on a bias; one said tear-away scored section nearest the discharge outlet lip, when severed yields a jet like stream, whereas the other scored section within the curved quadrant, when severed yields a spray like pattern, when said flexible container body contains liquid, is upended and manually squeezed.

7. The invention of claim 5, wherein said sealed container outlet is joined to the inlet of said squeezable thermoplastic self-closing valve portion, by a threaded connection, and the like.

8. The sealed container of claim 5, having an integral discharge outlet centrally located atop and aside said container, said integral discharge outlet being connected at the junction between the top portion of a hollow cored lifting handle located at an approximate 45 degree incline and said flexible thermoplastic elongated generally cylindrical discharge outlet nozzle being thermoformed into said squeezable thermoplastic self-closing valve including the outwardly tapered sides adjoining said self-closing valve, said outwardly sides being located at the container outlet discharge junction, close to the top portion of the inclined hollow cored lifting handle, thereby permitting the employment of a single hand, for lifting, tilting and pouring product while digitally squeezing the outwardly tapered sides of said squeezable thermoplastic self-closing valve.

* * * * *